US005601073A

United States Patent [19]

Shimek

[11] Patent Number: 5,601,073

[45] Date of Patent: Feb. 11, 1997

[54] FLAT PAN GAS BURNER FOR GAS FIREPLACES

[76] Inventor: Ronald J. Shimek, 6665 W. Hwy. 13, Savage, Minn. 55378

[21] Appl. No.: 369,742

[22] Filed: Jan. 6, 1995

[51] Int. Cl.[6] ..... F24C 3/00

[52] U.S. Cl. ..... 126/512; 126/91 R; 126/92 R; 431/125; 431/126

[58] Field of Search ..... 126/512, 91 R, 126/92 R; 431/126, 125, 326, 328, 329, 347

[56] References Cited

U.S. PATENT DOCUMENTS

| | | | |
|---|---|---|---|
| 3,385,651 | 5/1968 | Rasmussen et al. | 126/512 X |
| 4,838,241 | 6/1989 | Rieger | 126/512 X |
| 4,890,600 | 1/1990 | Meyers | 126/512 |
| 4,890,601 | 1/1990 | Potter | 126/512 |
| 4,971,031 | 11/1990 | Richardson | 126/512 |
| 5,000,162 | 3/1991 | Shimek et al. | 126/512 |
| 5,263,852 | 11/1993 | Beck | 126/512 X |
| 5,320,520 | 6/1994 | Barth et al. | 126/512 X |
| 5,328,356 | 7/1994 | Hawkinson | 431/125 |
| 5,399,084 | 3/1995 | McCullough et al. | 126/512 X |
| 5,429,495 | 7/1995 | Shimek et al. | 431/126 |

*Primary Examiner*—Larry Jones
*Attorney, Agent, or Firm*—John B. Sowell, ATT

[57] ABSTRACT

A flat pan gas burner for a gas log fireplace system comprises a U-shaped pan formed in a sheet of metal. The U-shaped pan is provided with attachment flanges and a gas pipe attachment aperture through which is attached a gas pipe adapter. A burner plate is further provided with a plurality of gas flame apertures in a predetermined pattern for creating a desired flame pattern below the gas log system. If desired, there is further provided a layer of porous ceramic material on the burner plate which is impregnated with metallic salts and which produces a desired lengthening and coloring of the gas flames of the gas burner. A rocking or sliding support of the flat pan gas burner imparts movements and/or different length to the colored flames.

19 Claims, 3 Drawing Sheets

FLAT PAN GAS BURNER FOR GAS FIREPLACES

BACKGROUND OF THE INVENTION

1. Field of the Invention

The present invention relates to efficient gas burners burning natural gas, and propane gaseous fuels. More particularly, the present invention relates to an efficient gas burner system for burning gaseous fuels in a manner that produces colored decorative flames and decorative embers which simulate wood burning.

2. Description of the Prior Art

Gas burner systems for gas logs are known. In our U.S. Pat. No. 5,000,162, a gas log burner system is shown and described which produces decorative flames that are directed between ceramic gas logs in a manner which does not cool the flames and produce excessive soot and carbon monoxide. This patent also shows and describes a gas burner for producing glowing embers with a high efficiency clean burner system. This glowing ember burner system is known to produce a line of flames having very shallow depth but not a bed of coals effect.

It would be desirable to provide a burner system that combines a bed of coals or embers effect with flames of different lengths and means for coloring the flames and the bed of coals or embers.

SUMMARY OF THE INVENTION

It is a primary object of the present invention to provide a novel flat plan gas burner system for producing decorative gas flames and a bed of coals in a gas fireplace system.

It is another primary object of the present invention to provide a novel flat plan burner system that includes a layer of formed ceramic fiber material attached to the burner top plate so that it simulates a bed of glowing embers or coals.

It is another primary object of the present invention to provide a carrier of metallic salts for coloring gas flames which is attached to the burner top plate of a flat pan gas burner system.

It is another primary object of the present invention to provide a system for moving the top plate of the burner so the flames appear to move horizontally in a gas fireplace system, thus simulating movement of flames as appears in a wood burning fireplace.

It is another primary object of the present invention to provide a flat pan gas burner that is produced at lower cost and is provided with predetermined patterns of gas ports for producing flames of different lengths in different areas of the burner system.

It is another primary object of the present invention to provide a flat pan gas burner system that is easily combined with prior art type burner systems.

It is another object of the present invention to provide a system for imparting a small rotation to the flat pan burner of the fireplace system to simulate the movement of flames in a wood burning fireplace.

It is another primary object of the present invention to provide a method for producing a burner top plate of formed steel and/or formed steel and laminated ceramic fiber.

It is another object of the present invention to provide a burner system that has gas ports in various planes and elevations so that it maximizes the aesthetic beauty of the flames in a gas burner system.

According to these and other objects of the present invention, there is provided a flat pan gas burner system for installation in a gas fireplace. The flat pan gas burner system comprises a burner that has a preprogrammed pattern of gas ports which can be moved to simulate the movement of flames and may be further provided with an impregnated porous ceramic layer which imparts color to the short and tall flames as well as creating a bed of embers or bed of coals effect.

DETAILED DESCRIPTION OF THE PREFERRED EMBODIMENTS

Figure 1:
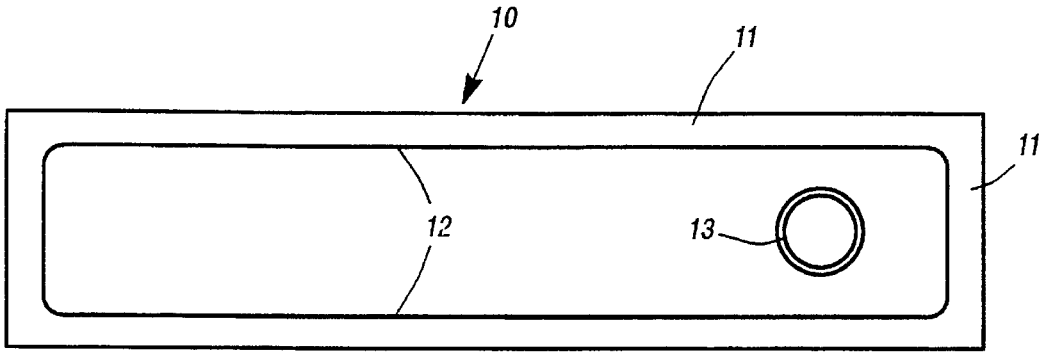
FIG. 1 is a plan view of a flat pan of a preferred embodiment gas burner system.
Figure 2:
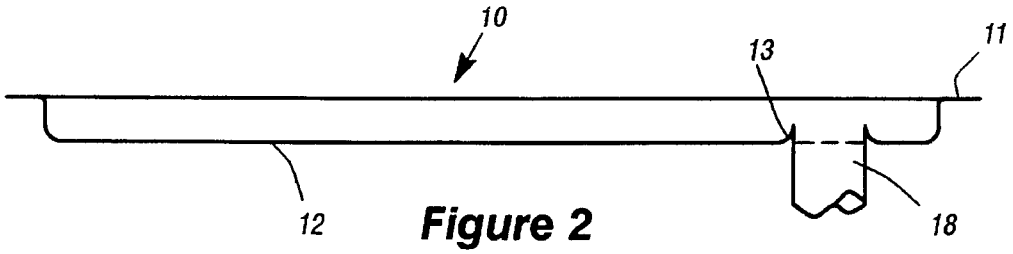
FIG. 2 is a section in elevation of the pan portion of the gas burner system shown in FIG. 1.

Refer now to FIGS. 1 and 2 showing a plan and elevation view of the pan portion 10 of a gas burner system. The pan 10 is provided with attachment flanges 11 and a drawn or U-shaped pan portion 12 in which there is further provided a gas pipe aperture 13 and gas pipe 18.

Figure 3:
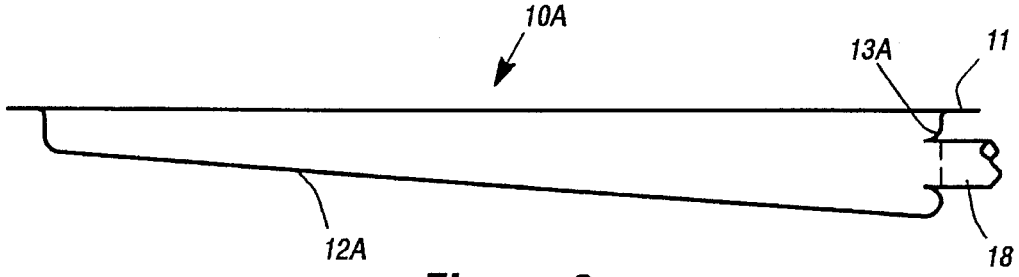
FIG. 3 is a section in elevation of a modified embodiment flat pan burner system.

Refer now to FIG. 3 showing a plan view of a modified flat pan 10A of a gas pan burner system. The drawn portion 12A is shown having an inclined U-shaped bottom 12A and a pipe aperture 13A in a vertical portion of the drawn pan. Attachment flanges and other features of the modified pan 10A are the same as those shown and described in FIGS. 1 and 2.

Figure 4:
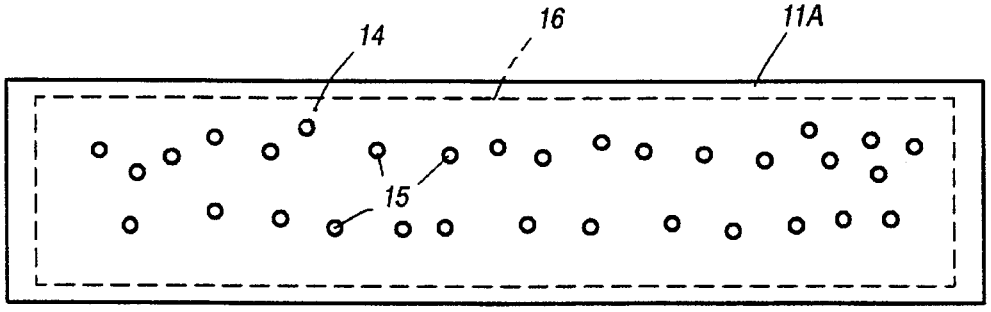
FIG. 4 is a plan view of a typical apertured burner plate of a preferred embodiment gas pan burner system.

Refer now to FIG. 4 showing a plan view of an apertured burner plate 14 of a preferred embodiment flat pan gas burner system. The flat plate is provided with a predetermined pattern of apertures or ports 15 for gas flames which are designed to direct flames in, on and between the log configuration with which they are used. The top flat plate 14 is shown having fold lines 16 shown in phantom lines along which the flanges 11A are lapped and wrapped over the flanges 11 of the pan 10. As will be explained, the term flat pan does not necessarily connote or mean that the top flat plate 14 must be horizontal or in a single plane. Further, the flat pan may be on the top or bottom.

Figure 5:
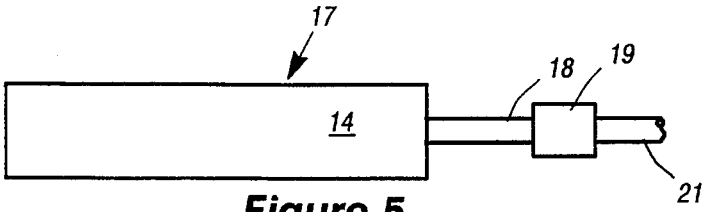
FIG. 5 is a schematic plan view of a flat pan burner system having an air shutter attached.

Refer now to FIG. 5 showing a schematic plan view of a flat pan gas burner 17 to which is attached a gas pipe 18 coupled to a primary air shutter 19 which controls the air fuel mixture for the gas in the supply pipe 21. The gas supply pipe 21 may be coupled through a flexible connector for permitting movement of the gas burner system 17.

Figure 6:
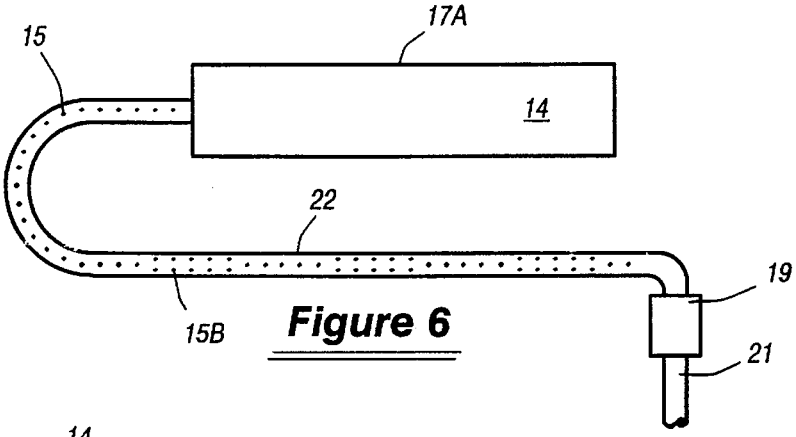
FIG. 6 is a plan view of a flat gas pan burner having a pipe burner attached.

Refer now to FIG. 6 showing a plan view of a gas pan burner system 17A connected through a typical pipe burner system 22 to a primary air shutter 19 and gas supply pipe 21. It will be understood that the top plates 14 of the gas burner system 17 and 17A are provided with a predetermined pattern of gas ports 15 (not shown). If the gas ports are provided close enough together, they also operate to migrate the flame from the pilot (not shown) to the end of the burner system. In FIGS. 6, the pipe burner 22 is provided with migration ports 15A and burner ports 15B which assure that the flame from the pilot light traverses the entire length of the burner system.

Figure 7:
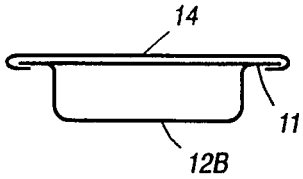
FIGS. 7, 8 and 9 are all sections in elevation taken through typical flat pan gas burner systems.
Figure 8:
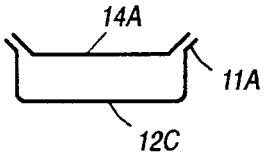
Figure 9:
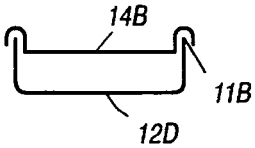
Figure 10:
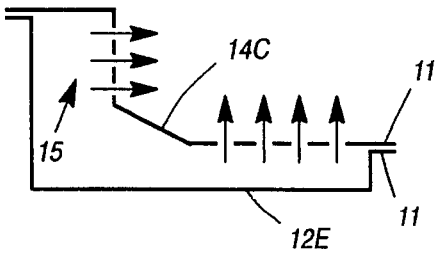
FIGS. 10, 11, 12 and 13 are all sections in elevations taken through typical gas pan burners having formed burner plates.
Figure 11:
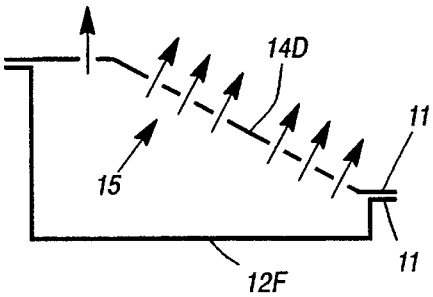
Figure 12:
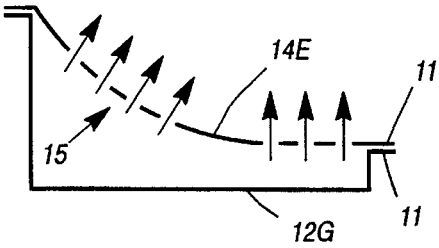
Figure 13:
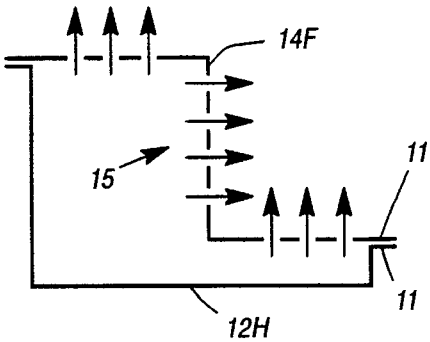

Refer now to FIGS. 7 through 9 showing sections in elevation taken through typical desirable flat pan gas burners. The numerals 14, 14A and 14B depict the top flat plates of a burner system in which the gas ports 15 are provided. The numerals 12B, 12C and 12D depict the pan portion of the burner system which is attached to the top flat plate 14 by swaging, by spot welding and/or by crimping to provide a sealed burner system between plates 14 and pans 12. It will be appreciated that the novel flat pan gas burner system essentially comprises two parts which are formed from sheet metal and easily assembled on an automatic production line for minimum cost and maximum quality and flexibility of providing a pattern of ports therein.

Refer now to FIGS. 10, 11, 12 and 13 showing sections in elevation taken through typical flat pan gas burner systems having formed burner plates 14C through 14F. The burner plates 14 are provided with ports 15 and flanges 11 which connect to the flanges 11 on the U-shape pan portion 12E through 12H. The flanges may be attached as parallel plates or folded in one or more of the configurations shown or suggested in FIGS. 7 through 9. Having explained that the top flat plate 14 need not have any particular flat configuration, it will be appreciated that the plate 14 may be inundated and formed to simulate the surface of a bed of embers or coals and that the ports 15 are preferably provided as a pattern before the plate is formed. After the plates 14 are formed, the plate may be coated with a porous or absorbent ceramic fiber material, while preserving the integrity of the ports 15. Preferably the ports are maintained open by providing air through the system while coating the ceramic fiber material over the plate 14. However, it is possible to coat the plates which have a fairly uniform surface and use a pattern of clean out probes to reconfirm the port pattern.

Figure 14:
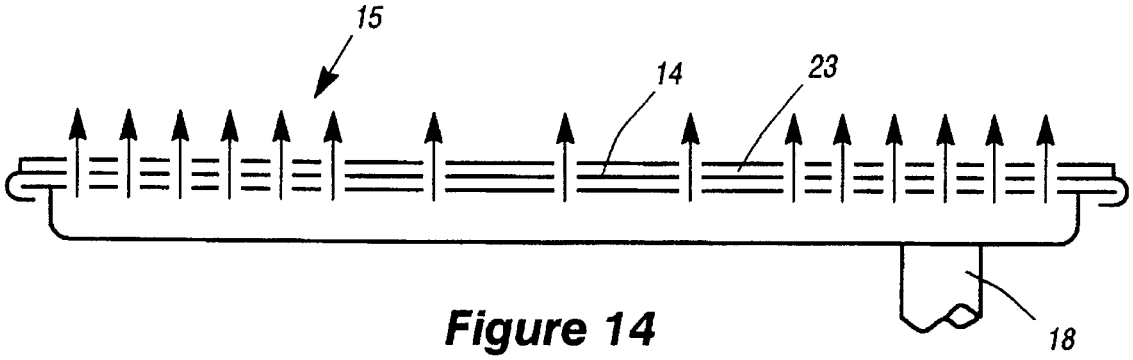
FIG. 14 is a section in elevation taken through a flat pan gas burner having a layer of porous ceramic material attached to the burner plate.

Refer now to FIG. 14 showing a section in elevation taken through a preferred embodiment flat pan gas burner having a layer of porous ceramic material 23 coated on top of the plate 14. It will be understood that FIG. 14 is a schematic representation and that the plate 14 may be a formed plate as well as a flat plate. In the preferred embodiment of the present invention, there are several methods of applying porous ceramic material 23. The ceramic material may be made into a slurry which may be applied by vacuum moulding a spray gun or a roller. If the coating is applied in a series of passes while air is applied through the pipe 18, the ports 15 will remain open. The layer may be partially dried and a second layer attached to build up a layer as thick as approximately ¼". It has been found that layers which are thicker than a ¼" tend to create a dirty burn rather than an efficient clean burn as well as diffusing the formed flame jet. Once the porous ceramic material 23 has dried, it is now possible to impregnate the material using known techniques such as brushing, spraying, sprinkling, etc. The material used for impregnating the porous ceramic material is metallic salts which are known to cause a coloring of the gas flames to more closely resemble colored flames of a gas burning system. Further, it has been observed that the coloring of the flames with metallic salts also increases the visible length of the gas flames.

Figure 15:
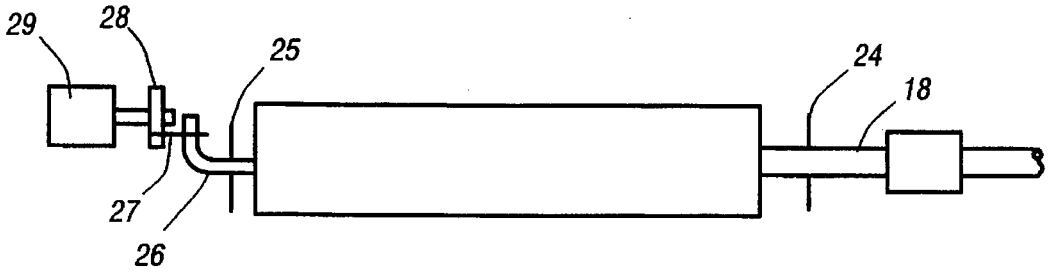
FIG. 15 is a schematic drawing of a flat pan gas burner in plan view mounted on pivot supports and having means for rocking the top plate of the gas burner system.

Refer now to FIG. 15 showing a schematic drawing of a flat pan gas burner in plan view mounted on a pair of pivot supports 24 and 25. The pivot 24 may support a pin or the pipe 18 at one end and a pin 26 with a bell crank lever 26 which cooperates the pin 27 on an eccentric drive 28 mounted on the shaft a motor 29. Thus it will be understood that the motor 29 can impart a very slight rocking motion which varies the flame height and flame projection angle from the burner system onto the gas logs of a fireplace system. In the preferred embodiment of the present invention, the gas log system is made from a very light fire resistance material which does not form a heat sink that would cool the gas flames and create carbon monoxide and inefficient burning.

Figure 16:
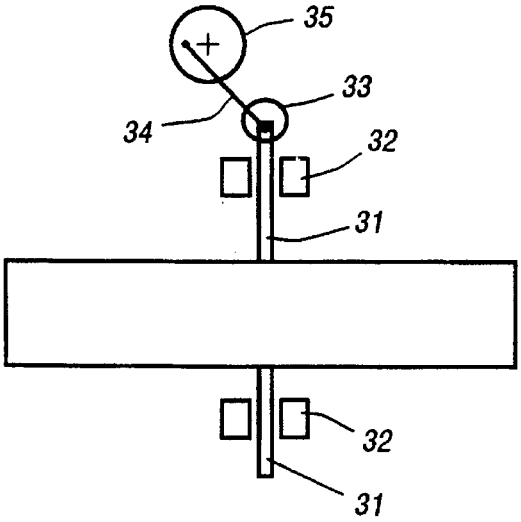
FIG. 16 is a schematic drawing of flat pan gas burner in plan view mounted on a sliding support and having means for imparting a reciprocating motion to the top plate of the gas burner system.

Refer now to FIG. 16 showing a schematic drawing of a flat pan gas burner in plan view which is mounted on a sliding support member 31. The slide support 31 is guided by guide blocks 32 and is connected at a pin 33 to a lever 34 which is pin connected to an eccentric drive 35. The eccentric drive 35 is connected to a motor like 29 (not shown). The motor when eliminated permits the slide support 31 to be extended to the front of the fireplace for manual adjustment of the flames.

Having explained a preferred embodiment of the present invention flat pan gas burner, it will be appreciated that the burner performs three functions. The burner first produces flames of desired size and length in a predetermined pattern which has depth and secondly, produces a bed of glowing coals or embers and coated with the ceramic material 23. Further, the bed of ceramic material 23 when impregnated with metallic salts is colored and further enhances the length and color of the flames produced by the novel burner system. The present burner system may be produced from substantially two parts that are economically formed with a minimum amount of waste material. In one embodiment of the present invention, the top plate 14 was made as an open frame and the ceramic material was attached to and formed on the frame leaving ceramic material to form the pattern of jets for the gas flames. While this embodiment is less desirable for a small burner, it may have advantages for large burner systems that have irregular surfaces. Such irregular surfaces may be formed by vacuum forming of the ceramic fiber material or forming the ceramic fiber on a formed mesh. The end result of the choice of parts and manufacturing of parts is that the flames may be controlled and moved to simulate dancing flames which occur with natural wood burning.

What is claimed is:

1. A pan type gas burner for a gas log fireplace system, comprising:

a pan formed in a sheet of metal, attachment flanges formed at the upper edges of said pan for attachment to a burner plate, a gas pipe aperture formed in said pan, a gas pipe adapter coupled to said aperture of said pan, a burner plate attached to said attachment flanges to form a closed gas burner, and a plurality of gas flame apertures in said burner plate adapted to create a desired predetermined flame pattern.

2. A pan type gas burner as set forth in claim 1 wherein said burner plate comprises a substantially flat plate, and porous ceramic glow material attached to said burner plate.

3. A pan type gas burner as set forth in claim 2 wherein said porous ceramic glow material further includes concentrated metallic salts impregnated into the porous ceramic glow material.

4. A pan type gas burner as set forth in claim 1 wherein said burner plate comprises a sheet metal plate, and a layer of porous ceramic material attached to said sheet metal plate having said apertures therein.

5. A pan gas type burner as set forth in claim 4 wherein said sheet metal plate comprises a continuous plate having apertures therein which match said apertures in said layer of ceramic material.

6. A pan type gas burner as set forth in claim 1 wherein said burner plate comprises a formed surface simulating a bed of coals, and porous ceramic glow material attached to said burner plate.

7. A pan type gas burner as set forth in claim 1 wherein said burner plate comprises a formed frame having a formed inundated porous ceramic material attached to said formed frame.

8. A pan type gas burner as set forth in claim 1 which further includes, means for movably supporting said gas burner, and means for imparting movement to said gas burner for effecting a desired movement of gas flames from said gas burner.

9. The method of making a pan type gas burner for a gas log fireplace system comprising the steps of:

forming a U-shaped pan with attachment flanges thereon and a gas pipe aperture therein, forming a burner plate, forming a plurality of gas flame apertures in said burner plate, providing a gas pipe adapter in said U-shaped pan, connecting said gas adapter to said gas pipe aperture of said U-shaped pan, and attaching said burner plate to said attachment flanges of said U-shaped pan to provide a closed pan type gas burner.

10. The method as set forth in claim 9 wherein the steps of forming said burner plate comprised the steps of making a sheet metal burner plate with a plurality of predetermined gas flame apertures therein, and attaching a continuous layer of porous ceramic material laminated over said sheet metal plate leaving said gas flame apertures exposed before attaching said burner plate to U-shaped pan.

11. The method as set forth in claim 10 which further includes forming an inundated surface in such sheet metal burner plate before attaching formable a layer of porous ceramic material thereon.

12. The method as set forth in claim 9 wherein said step of forming a burner plate comprises the steps of forming a sheet metal frame and vacuum forming a layer of ceramic fiber material thereon with apertures therein before attaching said metal frame to said U-shaped pan.

13. The method as set forth in claim 9 wherein said step of forming a burner plate comprises the step of forming an imperforate metal sheet and attaching a layer of ceramic material thereon, and the step of forming a plurality of gas flame apertures in said burner plate comprises the steps of simultaneously forming said apertures in said layer of ceramic fiber material and said burner plate.

14. The method as set forth in claim 9 wherein the step of forming said burner plate comprises apply at least one layer of ceramic material as a wet slurry, and drying said wet slurry layer to provide a porous ceramic material layer which conforms to said burner plate.

15. The method as set forth in claim 14 wherein the step of forming said burner plate comprises forming an irregular surface in said burner plate before applying said layer of ceramic material.

16. The method as set forth in claim 14 which further includes the step of impregnating said porous ceramic material layer with a metallic salt.

17. The method as set forth in claim 15 which further comprises the step of vacuum forming said porous ceramic material on said irregular surface.

18. The method as set forth in claim 9 which further includes the step of mounting said gas burner on a support for movement relative to said support.

19. The method as set forth in claim 18 which further includes the step of imparting movement to said gas burner to effect a desired movement of gas flames from said gas burner.

* * * * *